US010590679B2

(12) United States Patent
Steadman

(10) Patent No.: US 10,590,679 B2
(45) Date of Patent: Mar. 17, 2020

(54) SECURITY STRAP

(71) Applicant: William B. Steadman, Mead, OK (US)

(72) Inventor: William B. Steadman, Mead, OK (US)

( * ) Notice: Subject to any disclaimer, the term of this patent is extended or adjusted under 35 U.S.C. 154(b) by 0 days.

(21) Appl. No.: 15/968,750

(22) Filed: May 2, 2018

(65) Prior Publication Data

US 2019/0010729 A1 Jan. 10, 2019

Related U.S. Application Data

(60) Provisional application No. 62/528,650, filed on Jul. 5, 2017.

(51) Int. Cl.

| | |
|---|---|
| ***E05B 45/00*** | (2006.01) |
| ***E05B 73/00*** | (2006.01) |
| ***E05B 67/00*** | (2006.01) |
| ***E05C 19/18*** | (2006.01) |
| *E05B 47/00* | (2006.01) |
| *E05B 71/00* | (2006.01) |
| *E05B 35/00* | (2006.01) |

(52) U.S. Cl.

CPC ..... *E05B 45/005* (2013.01); *E05B 67/003* (2013.01); *E05B 73/0005* (2013.01); *E05C 19/184* (2013.01); *E05B 71/00* (2013.01); *E05B 2035/009* (2013.01); *E05B 2047/0094* (2013.01); *E05B 2047/0095* (2013.01)

(58) Field of Classification Search

None

See application file for complete search history.

(56) References Cited

U.S. PATENT DOCUMENTS

| | | | | |
|---|---|---|---|---|
| 5,525,966 | A * | 6/1996 | Parish | F41C 33/0227 224/243 |
| 6,254,025 | B1 * | 7/2001 | Liao | B65H 75/4434 242/378.1 |
| 6,305,632 | B1 * | 10/2001 | Hwang | B65H 75/486 242/372 |
| 7,028,939 | B2 * | 4/2006 | Liao | H02G 11/02 242/378 |
| 7,165,739 | B2 * | 1/2007 | Wei | B65H 75/4434 242/378.1 |
| 7,168,275 | B2 * | 1/2007 | Fawcett | E05B 45/005 242/382 |
| 7,201,342 | B2 * | 4/2007 | Huang | B65H 75/4431 242/378.2 |
| 8,068,027 | B2 * | 11/2011 | Auerbach | E05B 39/00 340/539.1 |

(Continued)

*Primary Examiner* — K. Wong

(74) *Attorney, Agent, or Firm* — Garrett James O'Sullivan

(57) ABSTRACT

A security device also referred to as a security strap comprises a locking mechanism having at least a first portion and a second portion, wherein the first portion and the second portion releasably engage one another. The security device has at least two attachment mechanisms, wherein one of the at least two attachment mechanisms extends outward from the locking mechanism, and wherein another of the at least two attachment mechanisms extends from the locking mechanism in an opposite direction to the one of the at least two attachment mechanisms, wherein each of the at least two attachment mechanisms are separated from the locking mechanism by a length of strap material, and wherein at least one of the at least two attachment mechanisms is attached to a substrate.

18 Claims, 6 Drawing Sheets

(56) References Cited

U.S. PATENT DOCUMENTS

| | | | | |
|---|---|---|---|---|
| 8,373,566 | B2 * | 2/2013 | Yang | B65D 63/14 340/10.1 |
| 8,915,971 | B2 * | 12/2014 | Hutzler | G06F 21/88 726/35 |
| 9,437,088 | B2 * | 9/2016 | Phillips | G08B 13/1427 |
| 9,487,970 | B2 * | 11/2016 | Conti | E05B 45/005 |
| 9,564,043 | B2 * | 2/2017 | Sanders | F41C 33/029 |
| 10,087,659 | B2 * | 10/2018 | Grant | E05B 73/0047 |
| 10,134,251 | B2 * | 11/2018 | Van Landingham, Jr. | E05B 73/0029 |
| 2005/0223756 | A1 * | 10/2005 | Ling | E05B 73/0005 70/30 |
| 2005/0231365 | A1 * | 10/2005 | Tester | G06K 19/07798 340/568.1 |
| 2006/0208857 | A1 * | 9/2006 | Wong | F41C 33/0209 340/5.82 |
| 2011/0227706 | A1 * | 9/2011 | Yang | G08B 13/1463 340/10.1 |
| 2017/0256148 | A1 * | 9/2017 | King | G08B 13/19613 |

* cited by examiner

SECURITY STRAP

CROSS-REFERENCE TO RELATED APPLICATION(S)

The present application priority to U.S. Provisional Patent Application No. 62/528,650 filed on Jul. 5, 2017, entitled "SECURITY STRAP" the entire disclosure of which is incorporated by reference herein.

BACKGROUND OF THE INVENTION

1. Field of Invention

The present invention relates to the field of locking mechanisms and security devices.

2. Description of Related Art

Locking systems are required for countless applications. Generally, cable locks, pad locks, and similar devices are used to prevent unwanted access into a compartment or to ensure that an object is not easily displaced from a stored position. Other less preventative methods of locking have included snap-type clips that retain a stored position while allowing for rapid access. A common illustrative example can be found in many firearm holster systems.

The use of firearms is an inherently dangerous activity requiring a great amount of responsibility and safety. Locks are generally provided to prevent unnecessary discharge of the firearm by physically restricting the action of the trigger. Holsters are generally firearm specific and are designed to cover the entire firearm. However, their protection relies on a their large and bulky size. Further, if a strap is included, it is a simple button or clip fastener system allowing for easy removal by anyone.

Where a strap is provided on a holster, it adds additional security. Similarly, security straps are seen being used on various other objects requiring additional protection. Luggage, cabinets, and locked compartments all benefit from additional security mechanisms. However, the current state of the art provides for generic locking systems requiring a combination, key, or simple detachment of a clip or fastener.

The straps on holsters and similar locking mechanisms involve friction type or snap-type locking mechanisms that allow easy access to an object retained by the strap. However, this easy access is available to all individuals seeking to access the object. In the above example of a holster, the snap-type strap allows for a firearm to be retained in the holster until the snap is disengaged and the firearm can be removed as it is no longer retained by the strap. The removal or displacement of the snap-type strap is available to anyone capable of overcoming the friction force of the snap.

With the increasing call for firearm safety, resolutions are passed that focus on various aspects of gun control, but these reforms often apply globally and are prohibitive to responsible gun owners or law enforcement.

Based on the foregoing, there is a need in the art for a system that will allow for maximum protection requiring unique user input to remove a physical barrier to entry or removal of an object retained by the locking mechanism. A dynamic locking system is needed to allow for rapid access in appropriate situations while simultaneously preventing unwanted access from unauthorized individuals.

SUMMARY OF THE INVENTION

A security device also referred to as a security strap comprises a locking mechanism having at least a first portion and a second portion, wherein the first portion and the second portion releasably engage one another. The security device has at least two attachment mechanisms, wherein one of the at least two attachment mechanisms extends outward from the locking mechanism, and wherein another of the at least two attachment mechanisms extends from the locking mechanism in an opposite direction to the one of the at least two attachment mechanisms, wherein each of the at least two attachment mechanisms are separated from the locking mechanism by a length of strap material, and wherein at least one of the at least two attachment mechanisms is attached to a substrate.

In an embodiment, the security strap further comprises a power source in communication with an input mechanism and one or more actuators, wherein the one or more actuators are disposed within the locking mechanism.

In an embodiment, the one or more actuators control operation of the locking mechanism from a locked position to an unlocked position.

In an embodiment, the strap material releasable engages the locking mechanism and the attachment mechanism at terminal ends of the strap material.

In an embodiment, the security strap further comprises a conductive wire disposed within he strap material, wherein the conductive wire creates an electrical circuit between a power source and an alarm.

In an embodiment, the security strap further comprises a transmission element configured to transmit a signal to a remote device if the electrical circuit is compromised.

In an embodiment, the security strap further comprises a a spring biased element disposed within a hollow interior of the second portion, wherein the hollow interior is configured to receive the first portion, and wherein the spring biased element engages the first portion.

In an embodiment, the security strap further comprises a power source in communication with an input mechanism and one or more actuators in communication with the power source and the input mechanism, wherein the one or more actuators are operated by the input mechanism, wherein the one or more actuators are disposed within the second portion of the locking mechanism, and wherein the one or more actuators engages the first portion of the locking mechanism in a locked position.

In an embodiment, the input mechanism is a wireless receiver, wherein the wireless receiver receives one or more signals from a remote device, wherein the one or ore signals operate the one or more actuators.

In an embodiment, the input mechanism is a fingerprint scanner, wherein the device further comprises a storage media and a processor.

In an embodiment, further comprises a tab mechanically connected to a plurality of gears within the locking mechanism, wherein the plurality of gears are configured to retain the first portion and the second portion to one another in a locked position, wherein when the tab is depressed, the plurality of gears are rotated and the first portion is released from the second portion.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
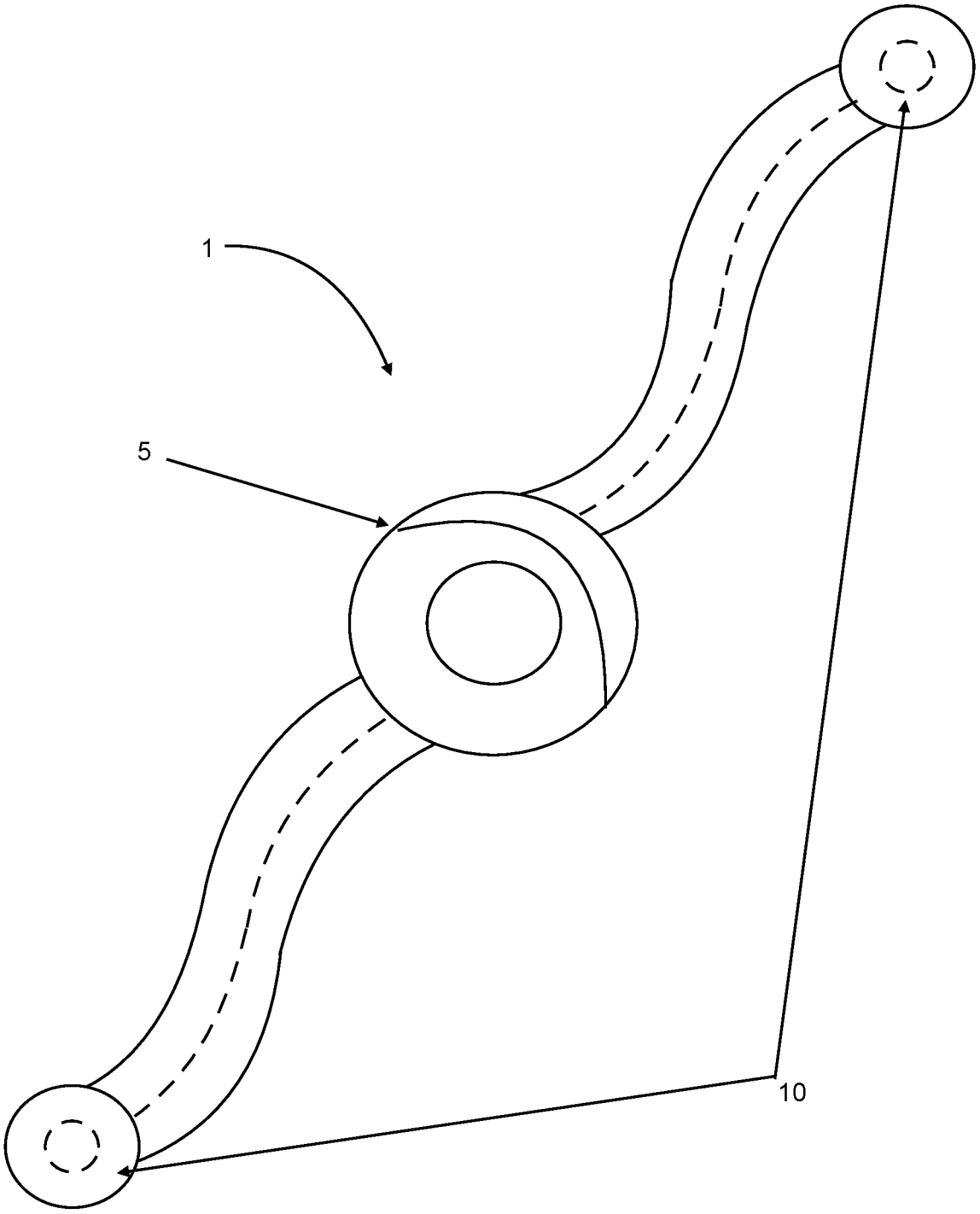
FIG. 1 is a perspective view of the security strap, according to an embodiment of the present invention.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

The present invention will now be described in detail with reference to embodiments thereof as illustrated in the accompanying drawings.

FIG. 1 illustrates a security strap 1 having a locking mechanism 5 in-between one or more attachment mechanisms 10. The locking mechanism 5 is generally disposed between a first end and a second end of the security strap such that he first end and the second end are defined by the terminal ends of the security strap. The one or more attachment mechanisms 10 is positioned substantially near each of the terminal ends of the security strap. The locking mechanism has at least two separate portions configured to positively engage one another in a locked position. The separate portions of the locking mechanism are separated from one another in an unlocked position such that he locking mechanism is separable into at least two components defined by the separate portions locking mechanism.

Figure 2:
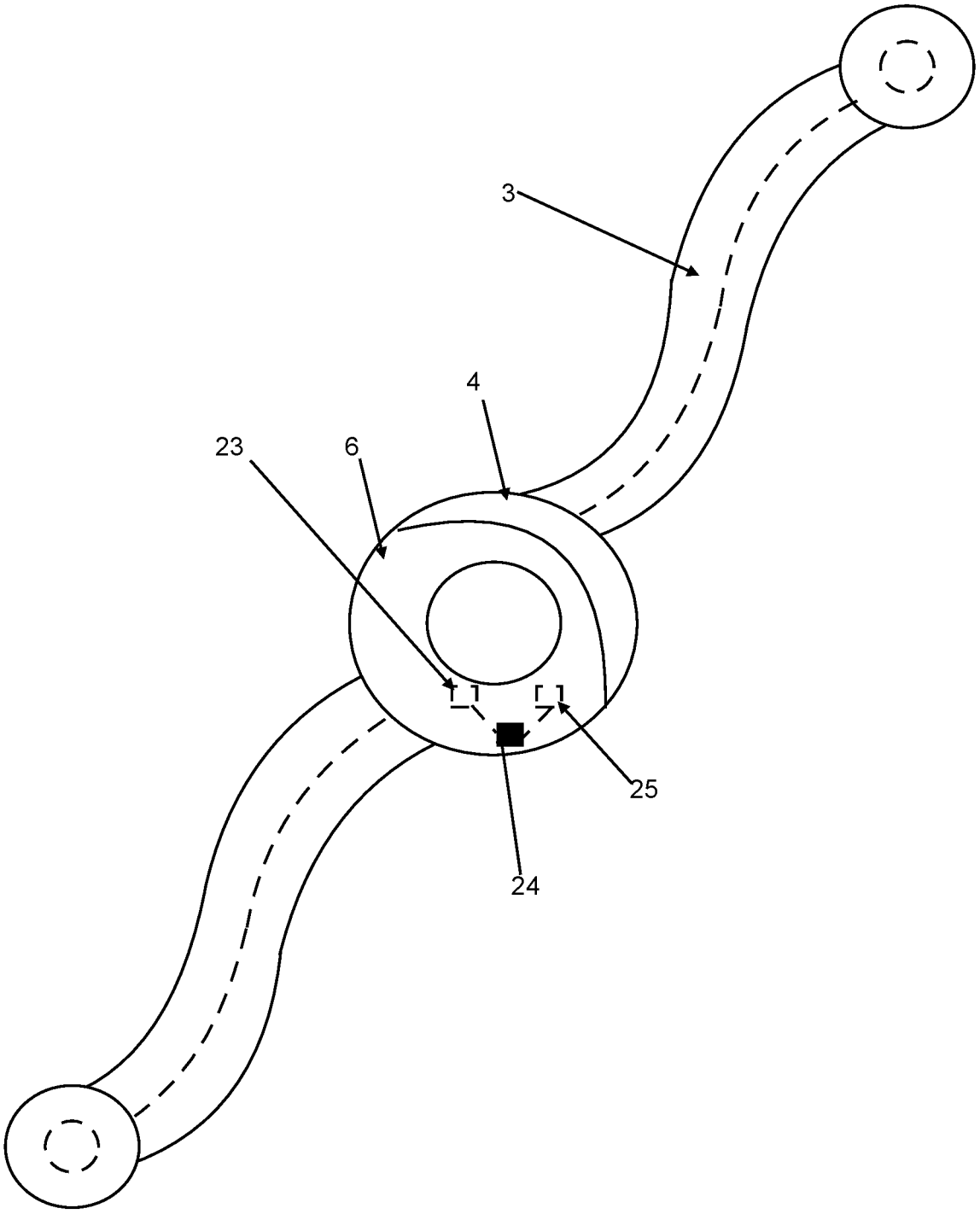
FIG. 2 is a top plan view of the security strap, according to an embodiment of the present invention.

In some embodiments, FIG. 2 illustrates a strap of material 3 separates one of the terminal ends from a corresponding separate portion of the locking mechanism 5. Where there are two separate portions of the locking mechanism, they are identified as a first portion 4 and a second portion 6. The strap of material 3 is affixed to one of the attachment mechanisms 10 and extends to an opposite end of the strap terminating in the first portion 4 of the locking mechanism. In such a configuration, a second strap of material is affixed to another attachment mechanism and extends to an opposite end of the second strap of material where the strap of material is affixed to the second portion 6 of the locking mechanism 5.

In some embodiments, each of the straps of material is comprised of a material having sufficient strength to resist breakage. A non-limiting example provides for a braided or aggregated weaved textile such that the individual fibers of the textile multiple the tinsel strength of the strap.

In some embodiment, each of the straps of material are comprised of additional components integrated into the strap and connected to any additional element of the security strap to promote the strength of the strap. A non-limiting example defines the strap by a length of metallic or carbon fiber material resisting cutting or physical insult. In another example, strands of metallic material may be embedded into the textile strap, as described above, to provide improved strength of the strap while allowing for a high level of flexibility in the strap overall.

The material used to manufacture the strap may be rigid or dynamic and allow for flexibility of the strap such that the attachment end and the locking mechanism portion end are adjustable relative to one another and to a desired substrate.

Figure 3:
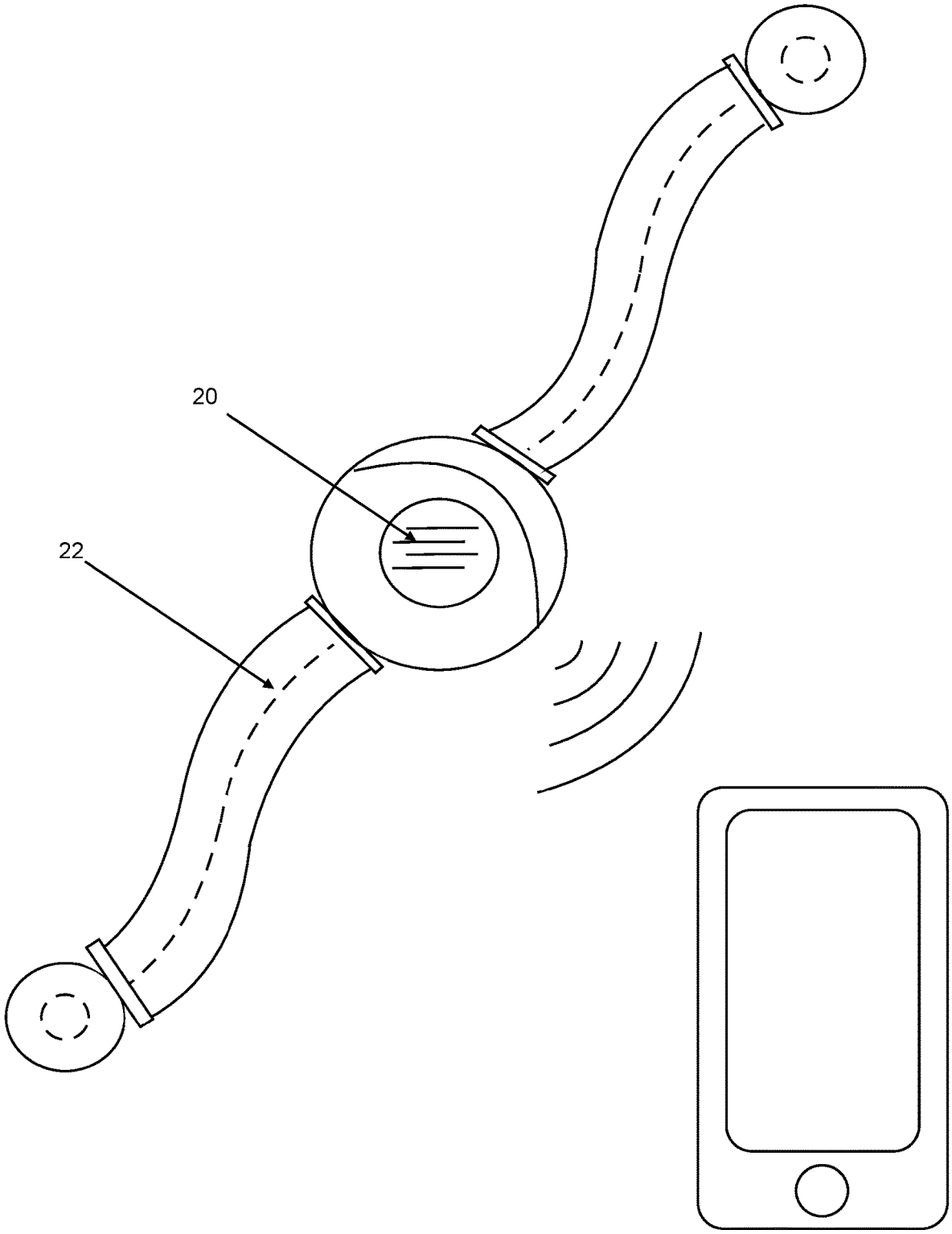
FIG. 3 is a side elevation view of the security strap, according to an embodiment of the present invention.
Figure 4:
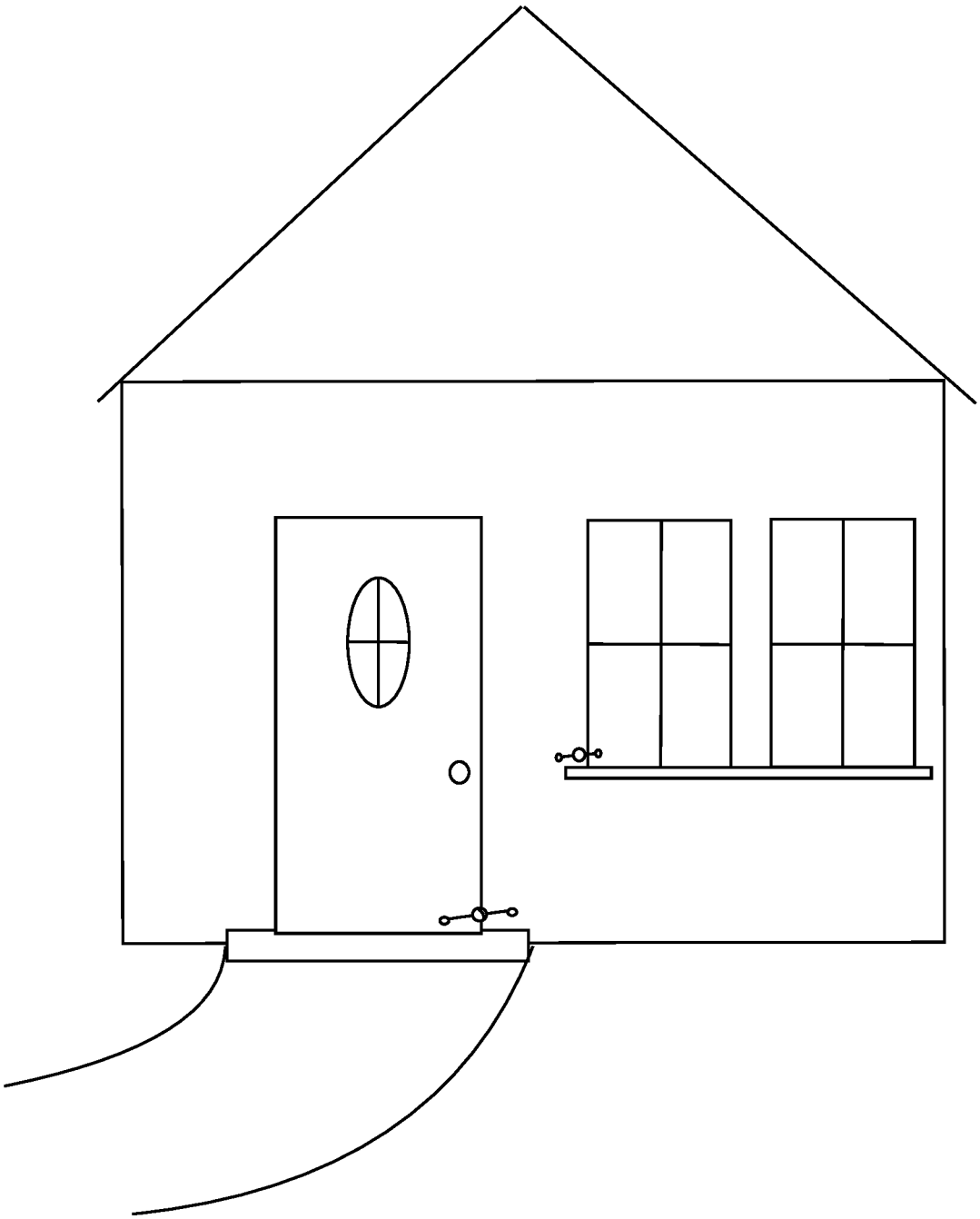
FIG. 4 is a perspective view of the security strap, according to an embodiment of the present invention
Figure 5:
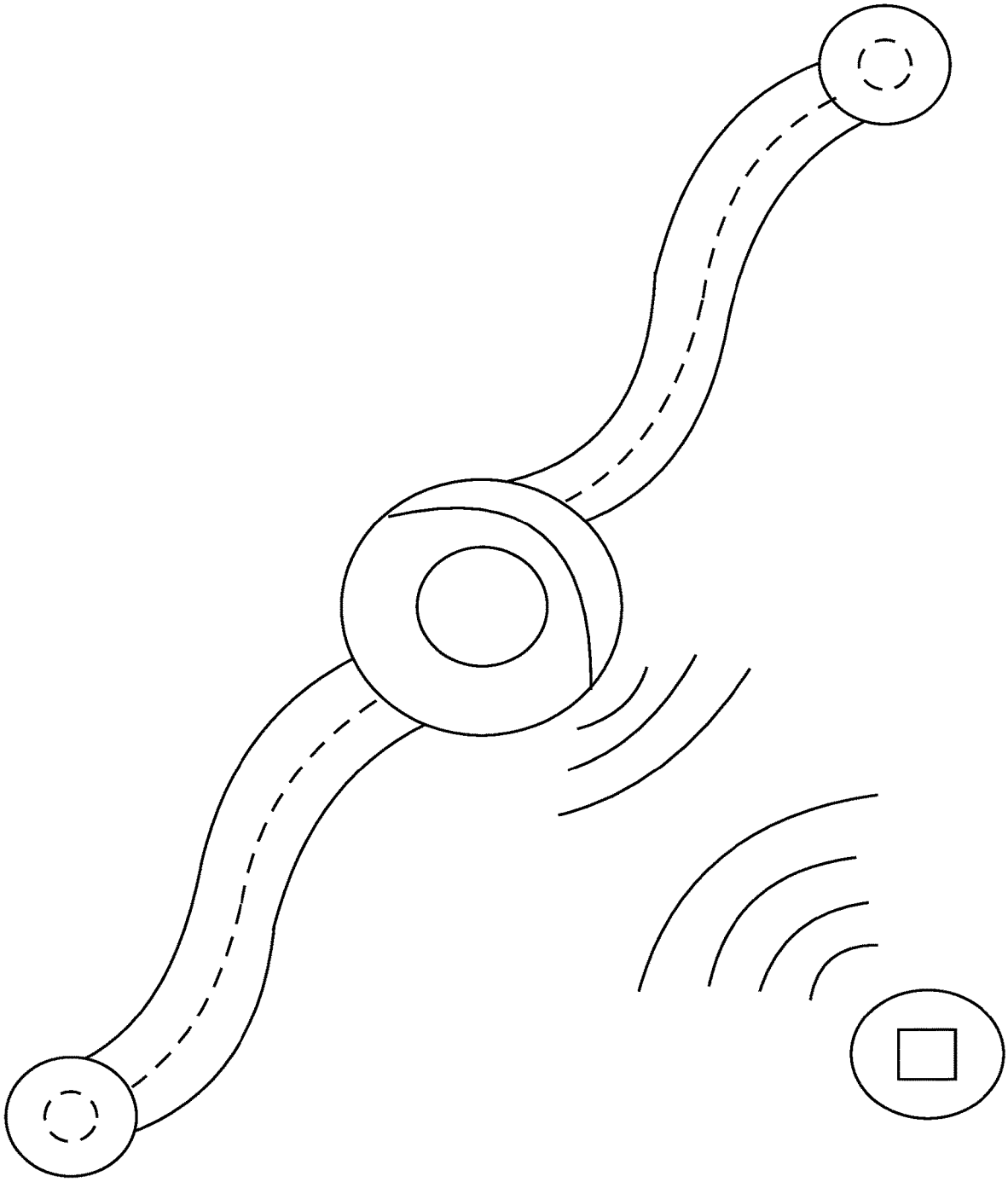
FIG. 5 is a side elevation view of the security strap, according to an embodiment of the present invention.

In an embodiment, each attachment mechanism is configured to removably engage a substrate such that the security strap is positioned relative to the substrate. FIGS. 1-3 illustrate the attachment mechanisms 10 may be friction fit snap-type clips 11 or clips requiring a first element and a second element whereby the first element is the attachment mechanism affixed to the strap of material and the second element is affixed to the desired substrate. The second element is configured to receive the first element such that a positive engagement is formed when the first element engages the second element. When the positive engagement is complete, the security strap will be retained to the substrate by the attachment mechanism.

In another embodiment, each attachment mechanism is permanently affixed to a desired substrate such that the security strap is statically positioned relative to the substrate. In such an embodiment, the security strap is only separated at the locking mechanism when the first portion and the second portion are separated from one another in an unlocked position. For example, when the security strap is required to lock a container, the attachment mechanisms may be welded, adhered, or integrated into the substrate of the container such that one of the attachment mechanisms is on a first side of the container and another attachment mechanism is on a second side of the container. In such an example, the first side of the container and the second side of the container are prevented from separating while the security strap is in a locked position. When the locking mechanism portions are disengaged in an unlocked position, the security strap allows the first and second sides of the container to separate.

Figure 6:
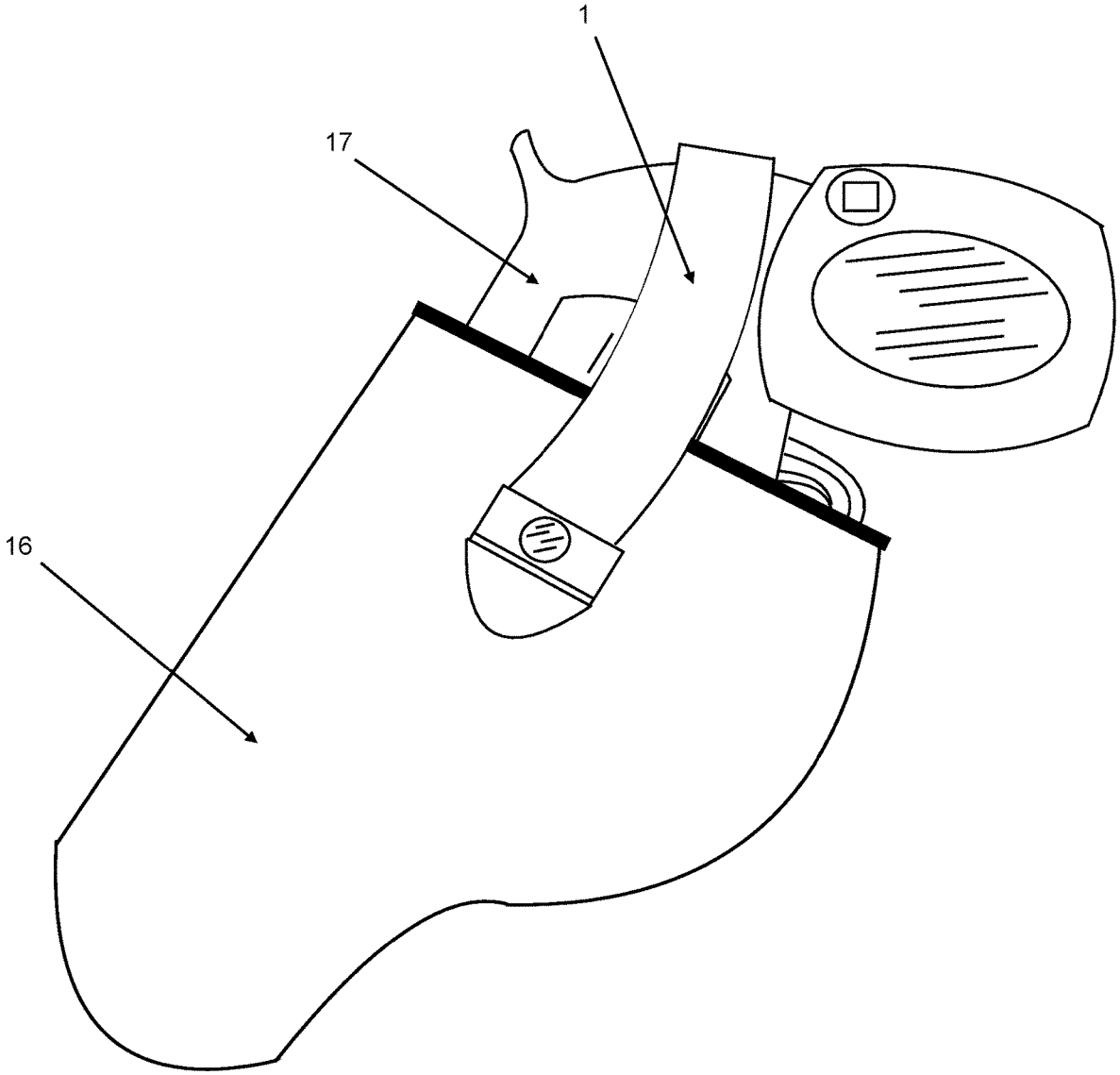
FIG. 6 is a side elevation view of the security strap, according to an embodiment of the present invention.

FIG. 6 illustrates a non-limiting example of use provide for the security strap 1 to be attached to a firearm holster 16. The holster has a hollow interior configured to receive muzzle of a firearm 17. The security strap 1 is affixed to an exterior surface of the holster such that a first attachment mechanism is affixed to a first side and the strap then extends across an opening into the hollow interior terminating in the second attachment mechanism which is affixed to an opposite side of the opening of the holster. The security strap allows the firearm to be positioned within the holster, when the security strap is in an unlocked position. After the firearm has been placed into the holster, a first side of the security strap consisting of the strap of material extending between the affixed attachment mechanism and the first portion of the locking mechanism is connected to the second side of the security strap consisting of the second attachment mechanism affixed to the opposite side of the holster and the strap of material extending between the second attachment mechanism and the second portion of the locking mechanism. In such an example, the first and second portions of the locking mechanism control the retention of the firearm within the holder based on their position being lock and attached, or unlocked and separated.

In some embodiments, the strap of material is releasbly attached to the attachment mechanism and the portion of the locking mechanism. In such an embodiment, the strap of material is interchangeable. For example, a user may require different lengths of a complete security strap. When this occurs the user can selectively interchange different length of strap of material between each attachment mechanism and the locking mechanism portions. A non-limiting illustrative example is provided when the security strap is required to retain a bicycle to a substrate. In such an example, the user may require a first length of strap material to be four feet in length and the second length of strap material to be only one foot in length. In this illustrative example, the total security strap would be five feet in length having a first side of four feet comprising the four foot section of strap material extending between the first attachment mechanism and the first portion of the locking mechanism; and the separate one foot section of strap material extending between the second attachment mechanism and the second portion of the locking mechanism.

In an embodiment, where the elements of the security strap are interchangeable, the elements may be attached to one another through screws, clips, fasteners, or pegs creating a positive attachment between the elements of the security strap. For example, a first portion of the locking mechanism may be attached to an end of the strap of material by aligning a series of holes or apertures of the strap of material to holes or apertures of the first portion of the locking mechanism and then inserting a peg or fastenered through the aligned holes. Similar attachment may be preformed at the attachment end of the strap of material between the strap of material and the attachment mechanism.

In an embodiment, each of the attachment mechanisms are configured to engage one another creating a loop of security strap. In such an embodiment, the attachment mechanisms are configured to retain one another indefinitely until an authorized user would separate them. In some embodiments the attachment mechanisms are permanently affixed to one another such that the security strap loop is continuous in a locked position and discontinuous loop in an open position whereby the locking mechanism portions separate from one another.

In an embodiment, the a peripheral locking mechanism is disposed within each of the attachment mechanisms. The peripheral locking mechanism allows for adaptability of the extent of the locking capability and attachment capability of the locking mechanism. For example, where one embodiment may provide for a snap-type attachment mechanism, the locking-type attachment mechanism having a peripheral locking mechanism disposed therein is better suited to retain the security strap to a substrate. In an embodiment, an input component is disposed on the exterior of the attachment mechanism having the peripheral locking mechanism and the input component is configured to receive user input for operation from a locked attachment position to an unlock attachment position thereby retaining the security strap or releasing the security strap from the substrate, repectively. The input component is in communication with the peripheral locking mechanism such that as the input component is engaged, the peripheral locking mechanism is transitioned between an active or inactive position. The active position results in a positive attachment with an attachment mechanism and a substrate.

In an embodiment, the locking mechanism, comprising at least the first locking mechanism portion and the second locking mechanism portion, has at least one power source in communication with a plurality of gears rotatably disposed within the locking mechanism. The gears are mechanically connected to a tab that, when manipulated rotates the plurality of gears. In this embodiment, the tab acts to selectively operate the locking mechanism from a locked position to an unlocked position. For example, where the security strap is in a locked position, the tab may be depressed and the gears rotated allowing for the first portion and the second portion to become separated from one another. Alternatively, the tab may be depressed as the security strap is transitioned from an unlocked position to a locked position whereby the tab needs to be depressed and the gears rotated to allow for an opening acceptance of the first and second locking mechanism portions into a locked position whereby the locked position is facilitated by the engaged plurality of gears.

In some embodiments, the first portion of the locking mechanism is a continuous rigid material having a top side and a bottom side. The bottom side has a probe extending outward therefrom. In such an embodiment, the second portion of the locking mechanism is a continuous rigid material having an aperture configured to receive the probe of the bottom of the first portion. As the probe is inserted into the second portion, the probe is received and retained by the second portion. For example, inside of the aperture of the second portion may be one or more spring biased clips and the probe may have a bulbous distal end relative to the bottom surface such that the bulbous end passed the spring biased clips and is retained therein until the user engages the spring biased clips to release the pressure on the bulbous head of the probe.

In another embodiment, the first portion of the locking mechanism is inserted into the second portion of the locking mechanism. Fro example, the second portion may have a hollow interior with a particular geometry defined by the shape and angle of interior surfaces. In such an example, the first portion has a corresponding exterior geometry to the interior geometry of the second portion.

In some embodiments, the engagement between the first portion of the locking mechanism and the second portion of the locking mechanism is facilitated through a friction fit. In further embodiments, the friction fit may be supported by spring biased elements within the second portion of the locking mechanism or on the first portion of the locking mechanism. The spring-biased elements are disposed on each portion of the locking mechanism to engage the opposite portion of the locking mechanism when the security strap is in a locked position. To separate the first portion of the locking mechanism from the second portion of the locking mechanism, the spring biased elements must be disengaged from contacting the opposite portion of the locking mechanism.

In some embodiments, operation of the locking mechanism requires user input.

In an embodiment, the user input is transmitted through engaging the tab, as described above. In another embodiment, the input may be an electrical signal. In such an embodiment, security strap has at least one power source electrically connected to a receiver, and the receiver electrically connected to one or more actuators within the locking mechanism. The actuators are selectively controlled by the user for the operation of the locking mechanism from a locked position to an unlocked position.

In an non-limiting example, the input may be a fingerprint. In such an embodiment, the security strap may have a fingerprint scanner integrated therein such that the user may engage the fingerprint scanner with the anterior portion of their finger containing their fingerprint. If the fingerprint is accepted as an authorized user, a signal will be transmitted to the locking mechanism components including the one or more actuators such that the actuators will transition the locking mechanism from a locked position to an unlocked position. If the fingerprint is not accepted, the actuators will retain the portions of the locking mechanism in a locked position preventing the security strap from being separated.

In an embodiment, FIG. 3 illustrates where the input component is a fingerprint scanner 20, the authorized user may establish their fingerprint through an initial setup of the security strap. For example, after the initial input, subsequent input of the user's fingerprint activates a motor or the plurality of actuators within the locking mechanism to lock or unlock the locking mechanism.

In use, the user contacts the input component with their fingerprint. If accepted, the locking mechanism initiates and the motor acts to rotate the plurality of gears translating rotational motion to the tab, which either engages the bulbous end of the probe or releases the same.

In another embodiment, FIG. 3 illustrates a length of conductive wire 22 is disposed within the strap material. The conductive wire closes a circuit of an alarm system. In such an embodiment, the security strap has a power source in communication with the conductive wire an alarm. If the conductive wire is severed, a circuit between the power source and the alarm is opened thereby triggering the alarm to notify the authorized user that the security strap is compromised.

In some embodiments, the alarm is audible such that the security strap emits an audible tone indicating that the strap of material has been tampered with or destroyed. In another embodiment, the alarm is silent and transmits a signal to a remote device indicating to the user with the remote device, that the strap has been compromised or tampered with. In such an embodiment, the security strap has a transmission element configured to transmit information about the integrity of the strap material.

In an embodiment, FIG. 2 illustrates the security strap has a gps element 23 in communication with the power source 24 and the transmission element 25. The gps element is configured to relay geographical location of the security strap to the user through a remote device or general transmission of the geolocation to a remote device retained by the authorized user.

In an embodiment, the length of material is selectively adjustable such that a clock spring or ratchet and gear mechanisms acts to set a length of material from within a housing and the length is set in a static distance between the attachment mechanisms. In such an embodiment, the strap material is wound around a coil controlled by the clock spring and the length of the wound strap material is drawn out against the clock spring bias until the desired length is achieved. Once the length is achieved, the clock spring may be locked in position to prevent unwanted extension beyond the set length.

In an alternative embodiment, the portions of the locking mechanism are engaged through their respective housings by rotating the housing of the first portion of the locking mechanism and the second mechanism against one another. As the housings are rotated against one another, each housing threadingly engages the other and ratchet-type element near each respective proximal end of the housing of each the first portion and the second portion of the locking mechanism engage one another to increase the attachment between the two housings.

In an embodiment, an external tracker is in communication with the security strap. The tracker is a peripheral component that communicates a position relative to the security strap such that the tracker can trigger the alarm system based on a displacement of the tracker from a certain threshold distance of the strap. A non-limiting example provides for the trigger of the alarm when the tracker is moved more than a set distance from the strap. The set distance is predetermined by the user and input into the strap through operational control from the mobile device. The tracker can be positioned on an object such as a firearm. FIG. 6 illustrates that the tracker is positioned onto the handle of the firearm and if the firearm were to be removed from the holster by an unauthorized user, the tracker would trigger the alarm when the tracker exceeded the threshold distance from the tracker.

In some embodiments, the security strap communicates a relative position with more than one tracker such that multiple trackers utilize a single strap as a relative position for an alarm to be triggered. As a non-limiting example, multiple trackers can be placed on multiple different firearms while the security strap is positioned on a safe, containing the tracked firearms. When a firearm is removed from the safe and the distance of the firearm with the tracker exceeds the threshold distance, the alarm is triggered and the location of both the tracker and the strap are provided or discoverable by the user.

In another embodiment, the first housing has a probe, as described above that is inserted into the housing of the second portion. The housing of the second portion is then rotated such that the internal elements of the housing retain the bulbous end of the probe of the first portion of the locking mechanism. The first portion of the locking mechanism is retained to the housing of the second portion of the locking mechanism until the housing is rotated in a opposite direction from the initial rotation.

In some embodiments, each attachment mechanism may be provided with one or more accelerometers. Each accelerometer acts as a trigger for the alarm system such that when the accelerometers are displaced, for example by someone tampering with the attachment mechanism, the accelerometer contact a sidewall of the accelerometer housing causing the alarm to be triggered. A non-limiting example provide for property protection whereby the security strap is deployed across a span of two substrates such as trees. If someone attempted to tamper with the placement of the security strap by removing one or more of the attachment mechanisms, they would disturb the accelerometer which would trigger the alarm and send a signal to the user.

In an alternative embodiment, the locking mechanism is one of the attachment mechanisms. In such an embodiment, there is only one attachment mechanism separated from the locking mechanism by a single strap. The locking mechanism may still have a first portion and a second portion, wherein one of the portions is connected to the strap and another portion of the strap is attached to the substrate.

In another embodiment, the locking mechanism is the attachment mechanism and the locking mechanism contains a momentary switch which is generally a spring biased switch that triggers or closes a circuit when the trigger portion of the switch is removed or displaced. For example, the momentary switch in the locking mechanism provides for a closed circuit between the conductive material positioned through the strap, the power source, the processor, and the one or more alarm systems. When the locking mechanism is removed from the substrate, for example, the locking mechanism is pulled away from an attachment point having a protuberance extending outward and configured to engage the momentary switch within the locking mechanism, the circuit is altered, for example opened or closed. The alteration of the circuit works to activate an alarm based on the alteration of the circuit. Another example provides for the locking mechanism attached to the protuberance of the attachment point and when the locking mechanism is displaced from the attachment point, the momentary switch is triggered and the alarm sounds.

In some embodiments, the operation of the security strap is predetermined or adjustable through the remote device such that alarm setting can be controlled to activate or deactivate at preset intervals or preset distances, as described above.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

I claim:

1. A security device comprising:

a. a locking mechanism having at least a first portion and a second portion, wherein the first portion and the second portion releasably engage one another;

b. at least two attachment mechanisms, wherein one of the at least two attachment mechanisms extends outward from the locking mechanism, and wherein another of the at least two attachment mechanisms extends from the locking mechanism in an opposite direction to the one of the at least two attachment mechanisms, wherein each of the at least two attachment mechanisms are separated from the locking mechanism by a length of strap material having an electrically conductive wire therein, wherein the strap material releasable engages the locking mechanism and the attachment mechanism at terminal ends of the strap material, wherein the strap is interchangeable with a separate strap of material having a different length, and wherein at least one of the at least two attachment mechanisms is attached to a substrate.

2. The device of claim 1, further comprising a GPS element configured to relay geographical location of the security device to a remote device.

3. The device of claim 1, wherein the conductive wire creates an electrical circuit between a power source and an alarm.

4. The device of claim 3, further comprising a firearm holster having a hollow interior configured to receive a firearm, wherein one of the at least two attachment means is affixed to the holster, and another of the at least two attachment mechanisms is affixed to an opposite side of the holster, wherein the locking mechanism is positioned over an opening to the hollow interior.

5. The device of claim 1, further comprising a tracker in remote communication with the security device.

6. The device of claim 5, wherein the tracker triggers an alarm within the security device when the security device is displaced a predetermined distance from the tracker.

7. The device of claim 6, wherein the tracker is positioned on an object secured by the security device.

8. The device of claim 1, further comprising an accelerometer trigger, wherein the accelerometer trigger triggers an alarm when the security device is displaced.

9. The device of claim 1 further comprising one or more attachment elements, wherein each of the one or more attachment elements are affixed to a substrate, wherein each of the one or more attachment elements are configured to reliably receive one or more of the at least two attachment mechanisms.

10. A security device comprising:

a. a locking mechanism having at least a first portion and a second portion, wherein the first portion and the second portion releasably engage one another;

b. at least two attachment mechanisms, wherein one of the at least two attachment mechanisms extends outward from the locking mechanism, and wherein another of the at least two attachment mechanisms extends from the locking mechanism in an opposite direction to the one of the at least two attachment mechanisms, wherein each of the at least two attachment mechanisms are separated from the locking mechanism by a length of strap material having an electrically conductive wire therein, wherein the strap material releasable engages the locking mechanism and the attachment mechanism at terminal ends of the strap material, wherein the strap is replaceable with a separate strap of material having a different length, and wherein at least one of the at least two attachment mechanisms is attached to a substrate.

11. The device of claim 10, further comprising a GPS element configured to relay geographical location of the security device to a remote device.

12. The device of claim 10, wherein the conductive wire creates an electrical circuit between a power source and an alarm.

13. The device of claim 12, further comprising a firearm holster having a hollow interior configured to receive a firearm, wherein one of the at least two attachment means is affixed to the holster, and another of the at least two attachment mechanisms is affixed to an opposite side of the holster, wherein the locking mechanism is positioned over an opening to the hollow interior.

14. The device of claim 10, further comprising a tracker in remote communication with the security device.

15. The device of claim 14, wherein the tracker triggers an alarm within the security device when the security device is displaced a predetermined distance from the tracker.

16. The device of claim 15, wherein the tracker is positioned on an object secured by the security device.

17. The device of claim 10, further comprising an accelerometer trigger, wherein the accelerometer trigger triggers an alarm when the security device is displaced.

18. The device of claim 10 further comprising one or more attachment elements, wherein each of the one or more attachment elements are affixed to a substrate, wherein each of the one or more attachment elements are configured to reliably receive one or more of the at least two attachment mechanisms.

* * * * *